US008439537B2

(12) United States Patent
Nakazato et al.

(10) Patent No.: US 8,439,537 B2
(45) Date of Patent: May 14, 2013

(54) LIGHTING FIXTURE

(75) Inventors: Yoshiaki Nakazato, Tokyo (JP); Yoshiaki Nakaya, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 35 days.

(21) Appl. No.: 13/228,435

(22) Filed: Sep. 8, 2011

(65) Prior Publication Data

US 2012/0063157 A1 Mar. 15, 2012

(30) Foreign Application Priority Data

Sep. 10, 2010 (JP) ..... 2010-203115

(51) Int. Cl.
*F21V 11/00* (2006.01)

(52) U.S. Cl.
USPC ..... 362/510; 362/84; 362/539; 362/545

(58) Field of Classification Search ..... 362/84, 362/517, 538, 543–545, 507, 509–510
See application file for complete search history.

(56) References Cited

U.S. PATENT DOCUMENTS 7,703,961 B2 * 4/2010 Yatsuda et al. ..... 362/545
8,070,339 B2 * 12/2011 Koike ..... 362/538
2010/0315829 A1 * 12/2010 Tokida et al. ..... 362/538

FOREIGN PATENT DOCUMENTS

JP 4124445 B2 7/2008

* cited by examiner

*Primary Examiner* — Diane Lee
*Assistant Examiner* — Gerald J Sufleta, II
(74) *Attorney, Agent, or Firm* — Kenealy Vaidya LLP

(57) ABSTRACT

A vehicular lighting fixture unit can include a projector lens placed on an optical axis extending in a vehicle front-rear direction. A light-emitting element can be placed between the projector lens and a rear-side focal point of the projector lens at a position lower than the optical axis so as to emit light substantially vertically upward. A phosphor can be placed so as to be closer to a vehicle rear side than the rear-side focal point. A first reflecting surface can reflect the light from the phosphor so as to condense the light toward the optical axis. A second reflecting surface can be placed substantially vertically above the light-emitting element at a position at which the second reflecting surface does not block the reflected light from the first reflecting surface. The second reflecting surface can reflect the light from the light-emitting element toward the phosphor.

18 Claims, 9 Drawing Sheets

RELATED ART

LIGHTING FIXTURE

This application claims the priority benefit under 35 U.S.C. §119 of Japanese Patent Application No. 2010-203115 filed on Sep. 10, 2010 which is hereby incorporated in its entirety by reference.

BACKGROUND

1. Field

The presently disclosed subject matter relates to a lighting fixture, and more particularly, to a small-sized vehicular lighting fixture unit having a size in an optical axis direction that is smaller than that of a conventional vehicular lighting fixture unit.

2. Description of the Related Art

Conventionally, in a field of vehicular lighting fixtures, a vehicular lighting fixture unit including: a phosphor; and a semiconductor light-emitting element placed apart from the phosphor has been proposed (see, for example, Japanese Patent No. 4124445).

As illustrated in FIG. 11, a vehicular lighting fixture unit 200 disclosed in Japanese Patent No. 4124445 includes a projector lens 210, a phosphor 220, a condenser lens 230, and a semiconductor light-emitting element 240 that are placed in the stated order from a vehicle front side to a vehicle rear side on an optical axis AX extending in a vehicle front-rear direction, and further includes a reflecting surface 250 placed above the phosphor 220.

SUMMARY

However, in the vehicular lighting fixture unit 200 disclosed in Japanese Patent No. 4124445, the semiconductor light-emitting element 240 is placed on the optical axis AX so as to be closer to the vehicle rear side than a rear end of the reflecting surface 250. Accordingly, a size of the vehicular lighting fixture unit 200 in the optical axis AX direction is unfavorably long.

The presently disclosed subject matter has been made in view of these and other circumstances and characteristics. The presently disclosed subject matter can include a small-sized vehicular lighting fixture unit having a size in an optical axis direction that is smaller than that of a conventional vehicular lighting fixture unit.

In particular, a vehicular lighting fixture unit according to one aspect of the presently disclosed subject matter can include: a projector lens placed on an optical axis extending in a vehicle front-rear direction; a light-emitting element placed between the projector lens and a rear-side focal point of the projector lens at a position lower than the optical axis so as to emit light substantially vertically upward; a phosphor placed so as to be closer to a vehicle rear side than the rear-side focal point of the projector lens, the phosphor configured to emit light when the light from the light-emitting element excites the phosphor; a first reflecting surface configured to reflect the light from the phosphor so as to condense the light toward the optical axis; and a second reflecting surface placed substantially vertically above the light-emitting element at a position at which the second reflecting surface does not block the reflected light from the first reflecting surface. The second reflecting surface can be configured to reflect the light from the light-emitting element toward the phosphor. In this aspect, the light-emitting element can be a semiconductor light-emitting element.

According to the above aspect of the presently disclosed subject matter, the semiconductor light-emitting element can be placed between the projector lens and the rear-side focal point of the projector lens at a position that is lower than the optical axis, whereby the size of the vehicular lighting fixture unit in the optical axis direction is defined by a rear end of the first reflecting surface. Accordingly, it is possible to configure the small-sized vehicular lighting fixture unit having the size in the optical axis direction that is smaller than that of a conventional vehicular lighting fixture unit.

The vehicular lighting fixture unit can further include a shade placed between the projector lens and the phosphor with an upper end edge of the shade being positioned in a vicinity of the rear-side focal point of the projector lens, the shade configured to block part of the reflected light from the first reflecting surface.

According to the above aspect of the presently disclosed subject matter, the shade makes it possible to configure the small-sized vehicular lighting fixture unit that forms a light distribution pattern for low beam including a cut-off line formed as a reverse projection image of the upper end edge of the shade on a virtual vertical screen facing a vehicle front-end part.

The second reflecting surface can be a spheroidal reflecting surface having a first focal point set in a vicinity of the light-emitting element and a second focal point set in a vicinity of the phosphor.

According to the above aspect of the presently disclosed subject matter, the second reflecting surface enables the light from the semiconductor light-emitting element to be condensed on the phosphor.

The vehicular lighting fixture unit can further include at least one condenser lens placed between the light-emitting element and the second reflecting surface, said at least one condenser lens configured to condense the light from the light-emitting element.

According to the above aspect of the presently disclosed subject matter, the condenser lens enables the light from the semiconductor light-emitting element to be condensed on the phosphor.

The vehicular lighting fixture unit can further include a collimator lens placed between the light-emitting element and the second reflecting surface, the collimator lens configured to convert the light from the light-emitting element into parallel light, wherein the second reflecting surface can be a curved mirror configured to condense the parallel light converted by the collimator lens on the phosphor.

According to the above aspect of the presently disclosed subject matter, the collimator lens and a concave mirror enable the light from the semiconductor light-emitting element to be condensed on the phosphor.

An angle at which the reflected light from the second reflecting surface enters the phosphor can be between 30 and 60 degrees.

According to the above aspect of the presently disclosed subject matter, the light conversion efficiency of the phosphor can be increased.

A longitudinal direction of a light source image of the light-emitting element can be placed so as to be orthogonal to the optical axis, the light source image being formed by the light emitted to the phosphor.

According to the above aspect of the presently disclosed subject matter, the longitudinal direction of the light source image of the semiconductor light-emitting element is placed so as to be orthogonal to the optical axis, the light source image being formed by the light emitted to the phosphor. Accordingly, white light from the phosphor forms a light source image with a longitudinal direction thereof being orthogonal to the optical axis, and a light distribution pattern that is wide in the horizontal direction can be achieved.

An area of a light source image of the light-emitting element can be equal to or less than one square millimeter, the light source image being formed by the light emitted to the phosphor.

According to the above aspect of the presently disclosed subject matter, the area of the light source image of the semiconductor light-emitting element is as small as equal to or less than one square millimeter, the light source image being formed by the light emitted to the phosphor the phosphor. Accordingly, a size smaller than that of the conventional vehicular lighting fixture unit can be achieved.

According to the presently disclosed subject matter, it is possible to provide the vehicular lighting fixture unit having the size in the optical axis direction that is smaller than that of the conventional vehicular lighting fixture unit.

DETAILED DESCRIPTION OF EXEMPLARY EMBODIMENTS

Hereinafter, a vehicular lighting fixture unit according to an embodiment of the presently disclosed subject matter is described with reference to the drawings.

A vehicular lighting fixture unit 10 of the present embodiment is an optical unit configured to form a light distribution pattern for low beam. The vehicular fixture unit 10 may constitute a vehicular headlight (headlamp) placed on both right and left sides of a vehicle front part.

Figure 1:
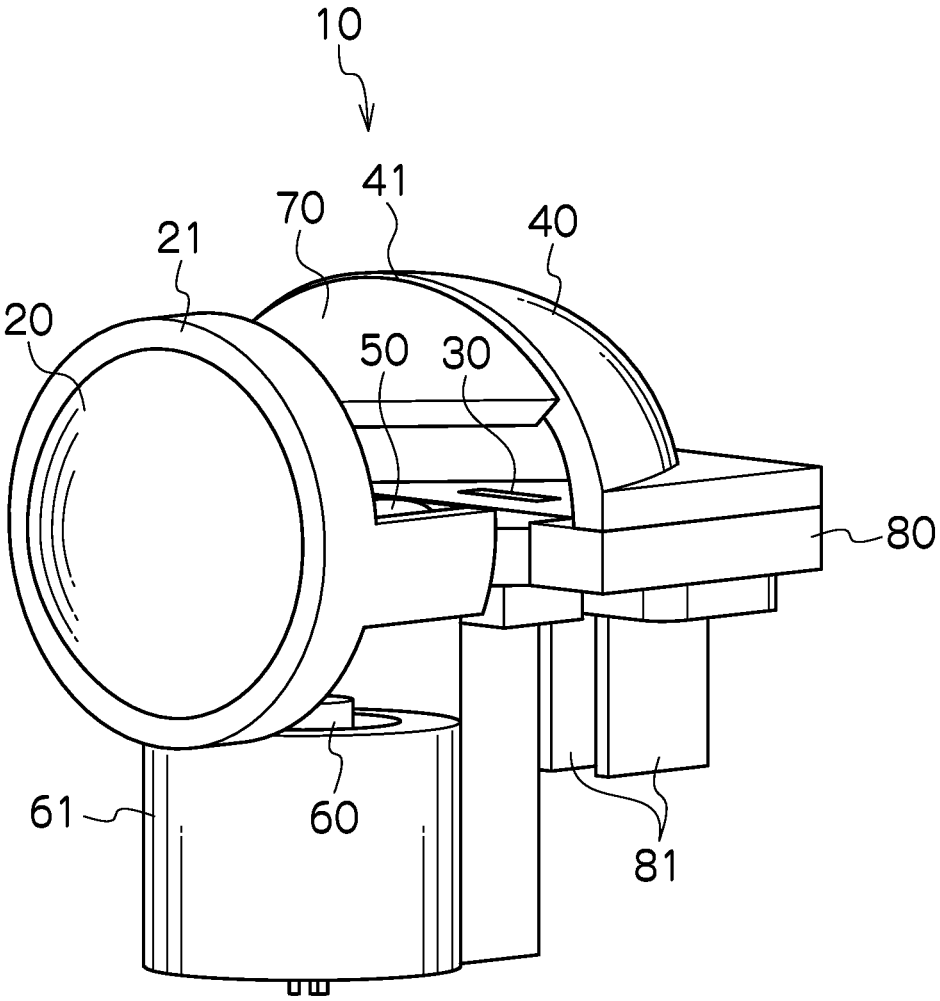
FIG. 1 is a perspective view of a vehicular lighting fixture unit according to an embodiment of the presently disclosed subject matter.
Figure 2:
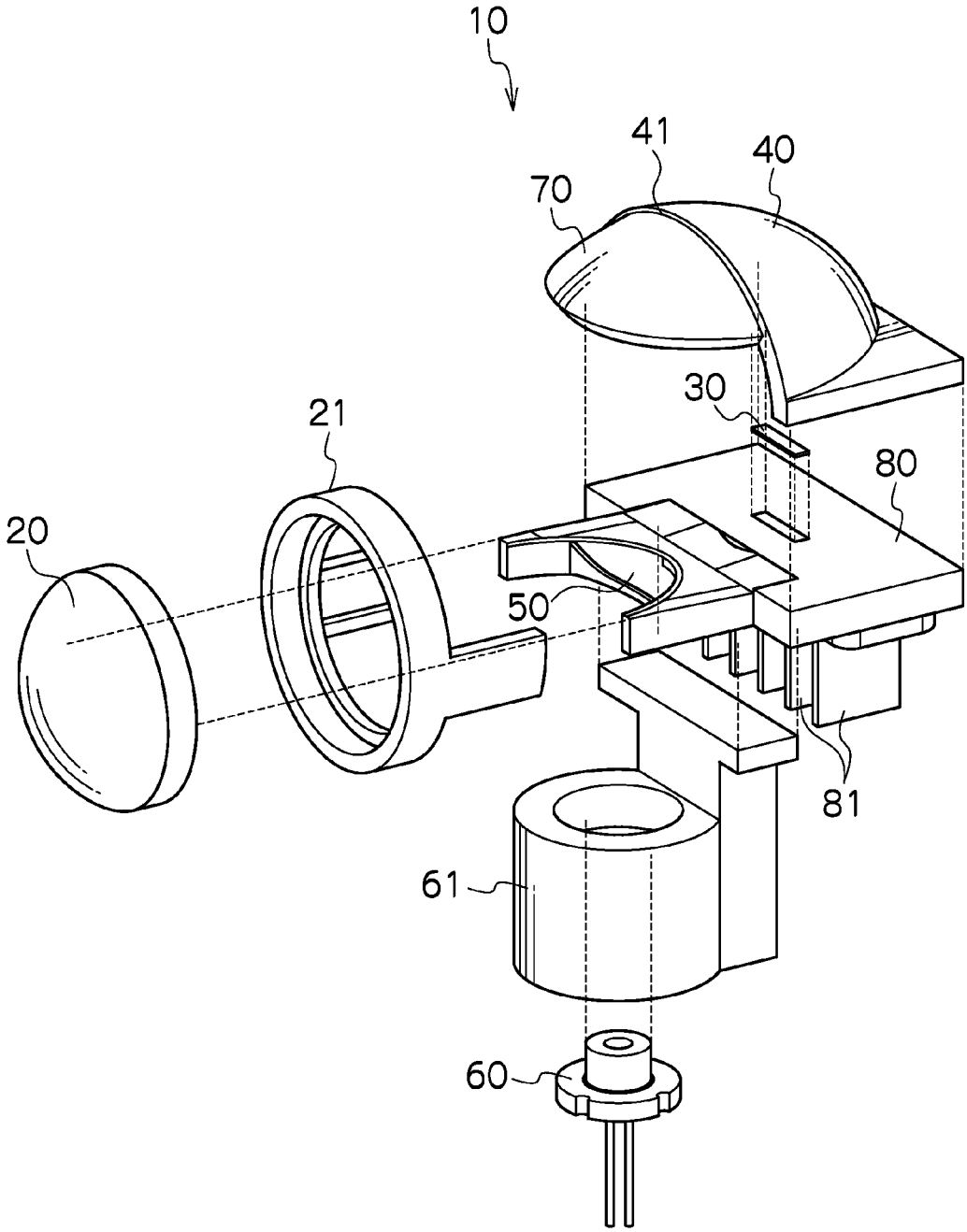
FIG. 2 is an exploded perspective view of the vehicular lighting fixture unit.
Figure 3:
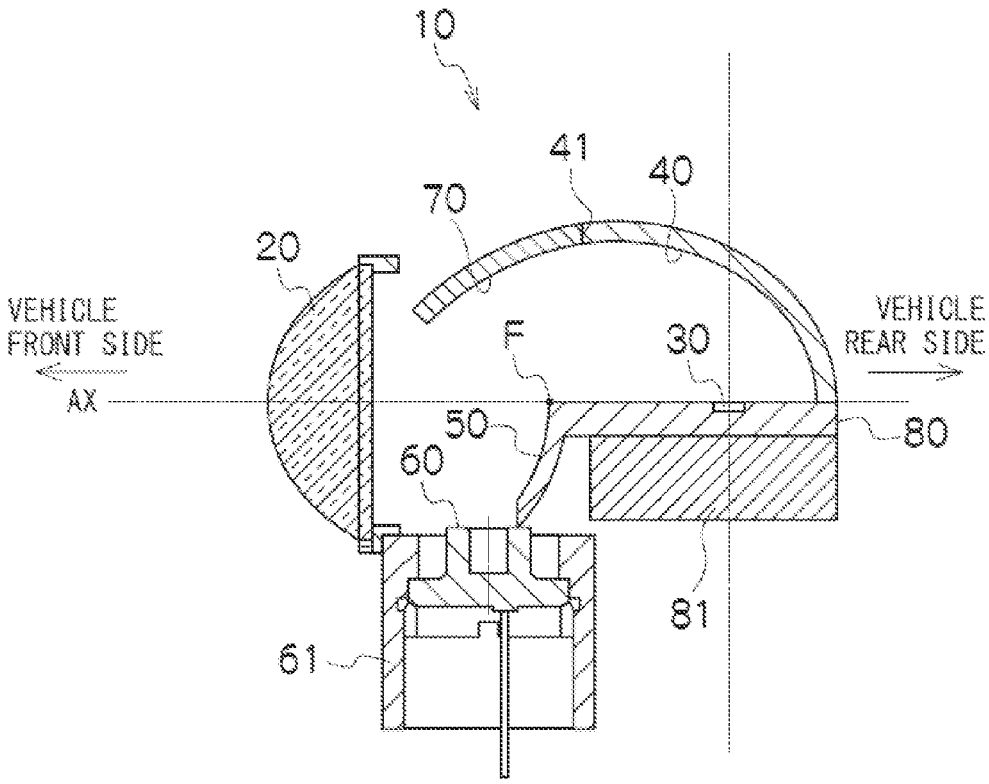
FIG. 3 is a cross-sectional view taken along a vertical cross-section including an optical axis AX of the vehicular lighting fixture unit.

As illustrated in FIGS. 1 to 3, the vehicular lighting fixture unit 10 of the present embodiment can include: a projector lens 20 placed on an optical axis AX extending in a vehicle front-rear direction; a phosphor 30 placed on the optical axis AX so as to be closer to a vehicle rear side than a rear-side focal point F of the projector lens 20; a first reflecting surface 40 configured to reflect light from the phosphor 30 so as to condense the light toward the optical axis AX; a shade 50 placed between the projector lens 20 and the phosphor 30 with an upper end edge thereof being positioned in the vicinity of the rear-side focal point F of the projector lens 20; a semiconductor light-emitting element 60 placed between the projector lens 20 and the rear-side focal point F of the projector lens 20 at a position lower than the optical axis AX so as to emit light substantially vertically upward; and a second reflecting surface 70 placed substantially vertically above the semiconductor light-emitting element 60 at a position at which the second reflecting surface 70 does not block the reflected light from the first reflecting surface 40.

The projector lens 20 can be a plano-convex aspherical lens with a vehicle front-side surface thereof being convex and a vehicle rear-side surface thereof being planar. For example, as illustrated in FIG. 1 and FIG. 2, the projector lens 20 is placed on the optical axis AX while being held by a lens holder 21 fixed to a metal member 80. The projector lens 20 projects a reverse image of a light source image formed on a rear-side focal plane thereof. As a result, a light distribution pattern P1 (see FIG. 5) can be formed on a virtual vertical screen facing a vehicle front-end part.

The phosphor 30 (in the present embodiment, a crystalline body such as YAG (Yttrium Aluminum Garnet)) emits light (in the present embodiment, yellow light) when light Ray1 (in the present embodiment, blue laser light; see FIG. 4A) from the semiconductor light-emitting element 60 excites the phosphor 30. The phosphor 30 can be placed on the optical axis AX so as to be closer to the vehicle rear side than the rear-side focal point F of the projector lens 20 (see FIG. 3). The phosphor 30 can emit white (simulated white or quasi-white) light by mixing colors of: scattered light from the semiconductor light-emitting element 60 that is scattered on a surface of the phosphor 30 or inside of the phosphor 30; and light emitted from the phosphor 30 excited by the light from the semiconductor light-emitting element 60 (see reference character and numeral Ray2 in FIG. 4B).

If the size of an image formed by the light condensed on the phosphor 30 (a light source image of a light-emitting part of the semiconductor light-emitting element 60) is smaller than the size of the phosphor 30, a light-emitting range is increased by light propagation. This results in an increase in the size of the vehicular lighting fixture unit. On the other hand, if the size of the image formed by the light condensed on the phosphor 30 (the light source image of the light-emitting part of the semiconductor light-emitting element 60) is larger than the size of the phosphor 30, a part of the light does not reach the phosphor 30. This results in a reduction in light utilization efficiency. In order to avoid the above described characteristics and problems, the size (area) of the phosphor 30 can be set to be substantially the same as the size of the image formed by the light condensed on the phosphor 30 (the light source image of the light-emitting part of the semiconductor light-emitting element 60). This configuration makes it possible to achieve a substantial point light source having substantially the same size as (the light-emitting part of) the semiconductor light-emitting element 60. Accordingly, the vehicular lighting fixture unit 10 can be configured to have a size smaller than that when the size of the image formed by the light condensed on the phosphor 30 is smaller than that of the phosphor 30. In addition, almost all the light from the semiconductor light-emitting element 60 enters the phosphor 30 and is less likely to be lost. Accordingly, the light utilization efficiency can be increased as compared to that when the size of the image formed by the light condensed on the phosphor 30 is larger than that of the phosphor 30.

As illustrated in FIG. 3, the phosphor 30 can be attached to an upper surface of the metal member 80 that has been subjected to mirror finishing such as aluminum vapor-deposition. Part of the light isotropically emitted from the phosphor 30 travels vertically downward and is reflected on the upper surface of the metal member 80 to travel upward. Therefore, the light traveling vertically downward can be reutilized, enabling a further increase in light utilization efficiency. In addition, the metal member 80 can include a heat-radiating fin 81, and the heat-radiating fin 81 enables efficient radiation of heat that is generated by the phosphor 30 due to its excitation. This makes it possible to suppress a decrease in light-emission luminance due to an increase in temperature of the phosphor 30. As a result, the luminance of the vehicular lighting fixture unit 10 may be increased.

The first reflecting surface 40 can be placed so as to cover a portion above the phosphor 30 such that light emitted upward from the phosphor 30 (and light reflected upward from the upper surface of the metal member 80) enters the first reflecting surface 40 (see FIG. 3). The cross-sectional shape of the first reflecting surface 40 including the optical axis AX can be set to be substantially elliptical. The eccentricity of the first reflecting surface 40 can be set to be gradually larger from a vertical cross-section toward a horizontal cross-section. With this configuration, the light Ray2 (see FIG. 4B) from the phosphor 30 reflected on the first reflecting surface 40 substantially converges around a forward portion of the rear-side focal point F on the vertical cross-section, whereas the light Ray2 substantially converges at a more forward portion thereof on the horizontal cross-section than on the vertical cross-section.

The shade 50 can be a light-blocking member configured to block part of the reflected light Ray2 from the first reflecting surface 40. The shade 50 can be placed between the projector lens 20 and the phosphor 30 with the upper end edge thereof being positioned in the vicinity of the rear-side focal point F of the projector lens 20 (see FIG. 3). Thus, the shade 50 blocks part of the reflected light Ray2 received from the first reflecting surface 40, to thereby form a cut-off line CL defined by the upper end edge thereof. The part of the reflected light Ray2 from the first reflecting surface 40 is reflected on an upper surface of the shade 50 that has been subjected to mirror finishing such as aluminum vapor-deposition, is bent by the projector lens 20 in a road surface direction, and is emitted forward. As a result, light utilization efficiency can be increased.

Figure 11:
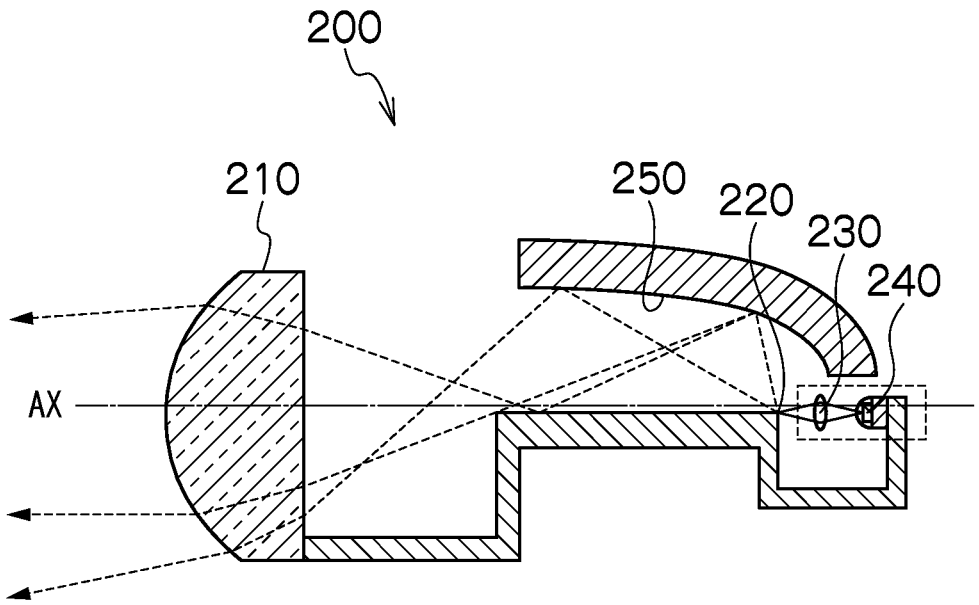
FIG. 11 is a vertical cross-sectional view of a conventional vehicular lighting fixture unit.

The semiconductor light-emitting element 60 can be a laser light source (for example, a laser diode) that emits, for example, blue laser light. As illustrated in FIG. 1 and FIG. 3, the semiconductor light-emitting element 60 can be placed between the projector lens 20 and the rear-side focal point F of the projector lens 20 at a position lower than the optical axis AX, while being held by a laser holder 61 fixed to the metal member 80. With this configuration, the size of the vehicular lighting fixture unit 10 in the optical axis AX direction is defined by a rear end of the first reflecting surface 40, and hence it is possible to configure the small-sized vehicular lighting fixture unit having a size in the optical axis AX direction that is smaller than that of a conventional vehicular lighting fixture unit 200 (see FIG. 11).

The shape of the light-emitting part of the semiconductor light-emitting element 60 can be formed into a line segment or a rectangle with one side being longer than another side. The semiconductor light-emitting element 60 can be placed such that the longitudinal direction of the light-emitting part thereof is orthogonal to the optical axis AX. Accordingly, the light source image of the semiconductor light-emitting element 60 that is formed by the light condensed on the phosphor 30 by the second reflecting surface 70 is substantially elliptical with a longitudinal direction thereof being orthogonal to the optical axis AX direction. As a result, the white light from the phosphor 30 forms a light source image with a longitudinal direction thereof being orthogonal to the optical axis AX, and a light distribution pattern that is wide in the horizontal direction can be achieved.

Figure 4A:
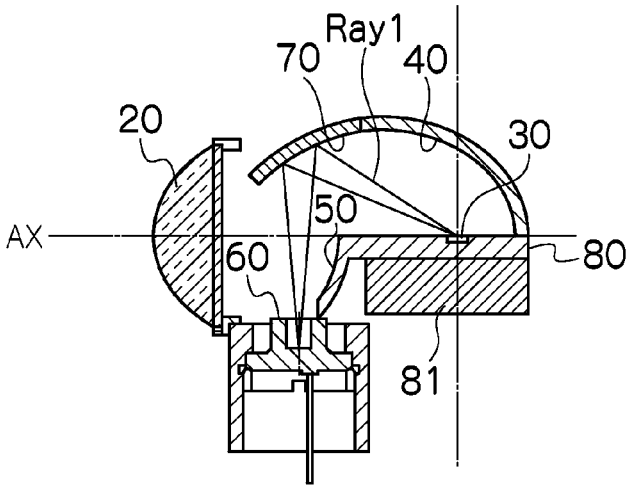
FIG. 4A is a view for describing an optical path of light from a semiconductor light-emitting element, the light being reflected on a second reflecting surface to be condensed on a phosphor.
Figure 4B:
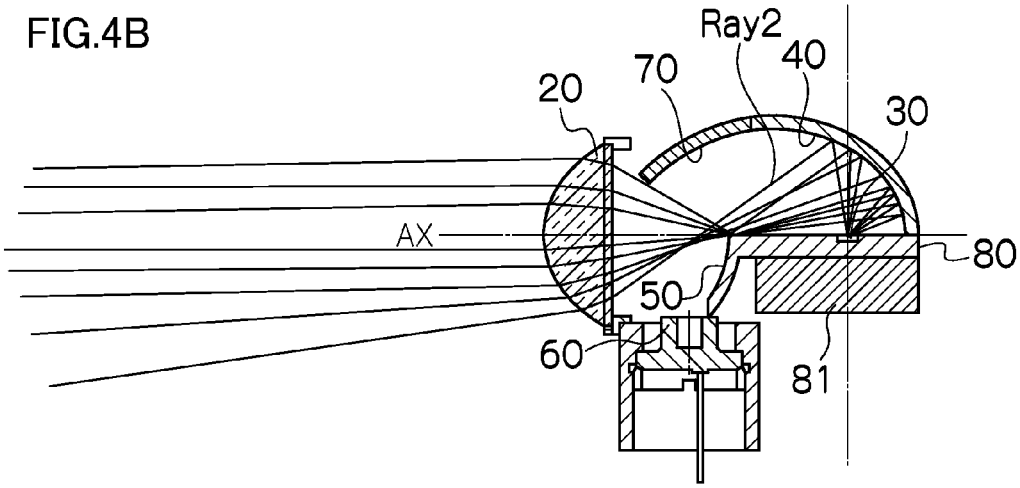
FIG. 4B is a view for describing an optical path of light from the phosphor, the light being reflected on a first reflecting surface and passing through a projector lens to be emitted forward.

In order to allow the light Ray1 from the semiconductor light-emitting element 60 to enter the second reflecting surface 70, the second reflecting surface 70 is placed substantially vertically above the semiconductor light-emitting element 60 at the position at which the second reflecting surface 70 does not block the reflected light Ray2 from the first reflecting surface 40 (see FIG. 4A and FIG. 4B).

The second reflecting surface 70 can be formed integrally with, for example, a vehicle front-side opening end 41 of the first reflecting surface 40. The second reflecting surface 70 can be placed so as to be closer to the vehicle front side than the vehicle front-side opening end 41 of the first reflecting surface 40 (see FIG. 3 and other figures). In the present embodiment, with the use of the second reflecting surface 70 placed so as to be closer to the vehicle front side than the vehicle front-side opening end 41 of the first reflecting surface 40, the semiconductor light-emitting element 60 can be placed between the projector lens 20 and the rear-side focal point F of the projector lens 20 at a position lower than the optical axis AX (see FIG. 3). With this configuration, the size of the vehicular lighting fixture unit 10 in the optical axis AX direction is defined by the rear end of the first reflecting surface 40, and hence it is possible to configure a small-sized vehicular lighting fixture unit having a size in the optical axis AX direction that is smaller than that of the conventional vehicular lighting fixture unit 200 (see FIG. 11).

An example of the second reflecting surface 70 includes a reflecting surface configured to enable the image formed by the light condensed on the phosphor 30 (the light source image of the light-emitting part of the semiconductor light-emitting element 60) to have substantially the same size as that of the phosphor 30. Specifically, the reflecting surface of the second reflecting surface 70 can be a spheroidal reflecting surface having a first focal point set in the vicinity of (the light-emitting surface of) the semiconductor light-emitting element 60 and a second focal point set in the vicinity of the phosphor 30. In order to increase light conversion efficiency of the phosphor 30, it is desirable that an angle at which (a principal ray of) the reflected light Ray1 from the second reflecting surface 70 enters the phosphor 30 be between 30 and 60 degrees (in the present embodiment, 45 degrees). The angle at which (the principal ray of) the reflected light Ray1 from the second reflecting surface 70 enters the phosphor 30 can be adjusted to fall within the above-mentioned angle range, by adjusting a relative positional relation among unit constituent elements such as the semiconductor light-emitting element 60, the second reflecting surface 70, and the phosphor 30.

Next, description is given of the light distribution pattern P1 for low beam that is formed on the virtual vertical screen facing the vehicle front-end part by the vehicular lighting fixture unit 10.

Figure 5:
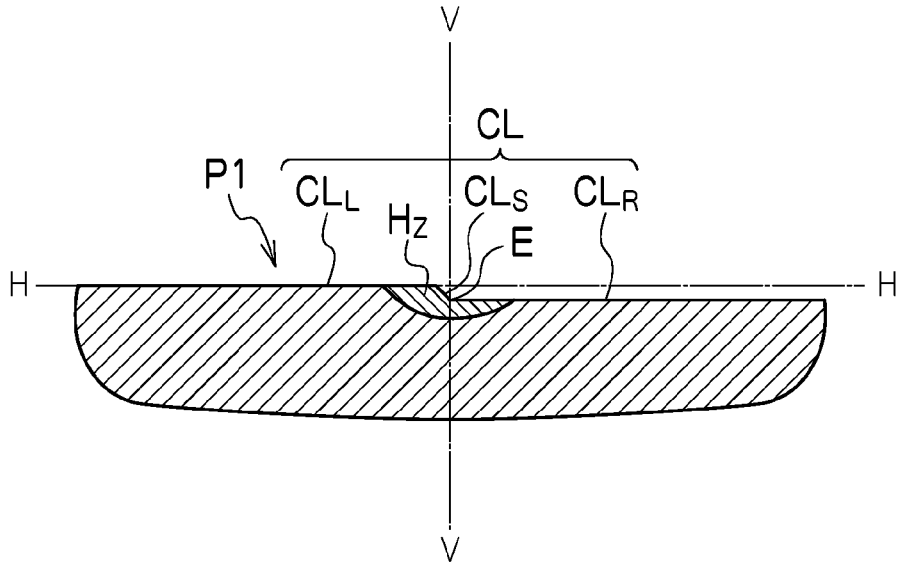
FIG. 5 illustrates an example of a light distribution pattern for low beam that is formed on a virtual vertical screen facing a vehicle front-end part by the vehicular lighting fixture unit.

As illustrated in FIG. 5, the light distribution pattern P1 for low beam is a light distribution pattern for low beam with higher light distribution on the left side, and includes the cut-off line CL having a difference in level between the right and left sides at an upper end edge thereof. The cut-off line CL is formed as a reverse projection image of the upper end edge of the shade 50.

The cut-off line CL extends in the horizontal direction on the level difference between the right and left sides with respect to a line V-V that is a vertical line passing through H-V being a vanishing point in a lighting fixture front direction. The right side from the line V-V is formed as an oncoming lane cut-off line $CL_R$ so as to extend in the horizontal direction, and the left side from the line V-V is formed as a driving lane cut-off line $CL_L$ so as to extend in the horizontal direction on the level higher than that of the oncoming lane cut-off line $CL_R$. Further, an end part of the driving lane cut-off line $CL_L$ near the line V-V is formed as an inclined cut-off line $CL_S$. The inclined cut-off line $CL_S$ extends at an angle (for example, approximately 45°) of inclination toward the upper left from an intersection point between the oncoming lane cut-off line $CL_R$ and the line V-V. Note that the shape of the cut-off line CL can be reversed in the case of right-hand traffic.

In the light distribution pattern P1 for low beam, an elbow point E corresponding to the intersection point between the oncoming lane cut-off line $CL_R$ and the line V-V can be positioned below H-H by approximately 0.5° to 0.6°. A hot zone $H_z$ configured as a high-luminosity region can be formed so as to surround the elbow point E to the left a little more than to the right.

Figure 6:
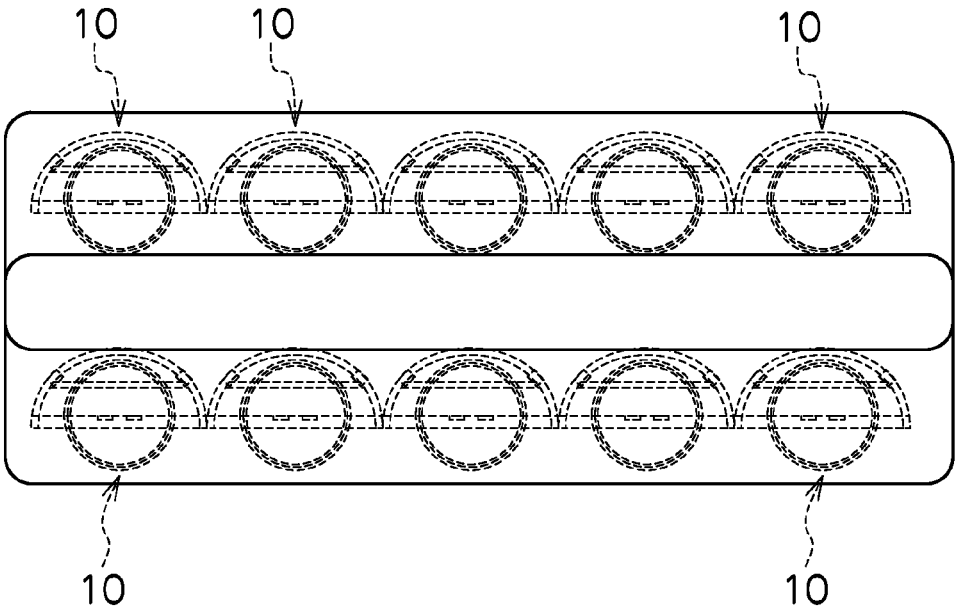
FIG. 6 illustrates an example in which a vehicular headlight (for example, a vehicular headlight placed on a vehicle front-end left side) is formed using a plurality of the vehicular lighting fixture units.

Note that, in the case where a light flux of one vehicular lighting fixture unit 10 is not sufficient, a plurality of vehicular lighting fixture units 10 can be used (see, for example, FIG. 6), and the light distribution patterns P1 for low beam respectively formed by the vehicular lighting fixture units 10 can be superimposed on one another, whereby a light distribution pattern for low beam having a required brightness can be formed.

As described above, according to the vehicular lighting fixture unit 10 of the present embodiment, with the use of the second reflecting surface 70 that is placed so as to be closer to the vehicle front side than the vehicle front-side opening end 41 of the first reflecting surface 40 (see FIG. 3), the semiconductor light-emitting element 60 can be placed between the projector lens 20 and the rear-side focal point F of the projector lens 20 at a position lower than the optical axis AX (see FIG. 3). With this configuration, the size of the vehicular lighting fixture unit 10 in the optical axis AX direction is defined by the rear end of the first reflecting surface 40, and hence it is possible to configure the small-sized vehicular lighting fixture unit having a size in the optical axis AX direction that is smaller than that of the conventional vehicular lighting fixture unit 200 (see FIG. 11).

In addition, according to the vehicular lighting fixture unit 10 of the present embodiment, the second reflecting surface 70 can be formed integrally with the first reflecting surface 40 and used as a member for condensing the light from the semiconductor light-emitting element 60 on the phosphor 30. Accordingly, the number of components, man-hours for assembly, production cost, and the like can be reduced compared with those of the conventional vehicular lighting fixture unit 200 (see FIG. 11) which includes the condenser lens 230.

In addition, according to the vehicular lighting fixture unit 10 of the present embodiment, the light from the semiconductor light-emitting element 60 is emitted from the second reflecting surface 70 to the phosphor 30. Accordingly, the light utilization efficiency can be increased.

In addition, according to the vehicular lighting fixture unit 10 of the present embodiment, the phosphor 30 and the semiconductor light-emitting element 60 are placed separate from each other (see FIG. 3 and other figures), and the phosphor 30 can be attached to the metal member 80. Accordingly, it is possible to suppress a decrease in light-emission luminance due to an increase in temperature of the phosphor 30. As a result, the luminance of the vehicular lighting fixture unit 10 can be increased.

Next, modified examples are described.

Modified Example 1

In the above-mentioned embodiment, description is given assuming that the second reflecting surface 70 is a spheroidal reflecting surface. However, the presently disclosed subject matter is not limited thereto.

Figure 7A:
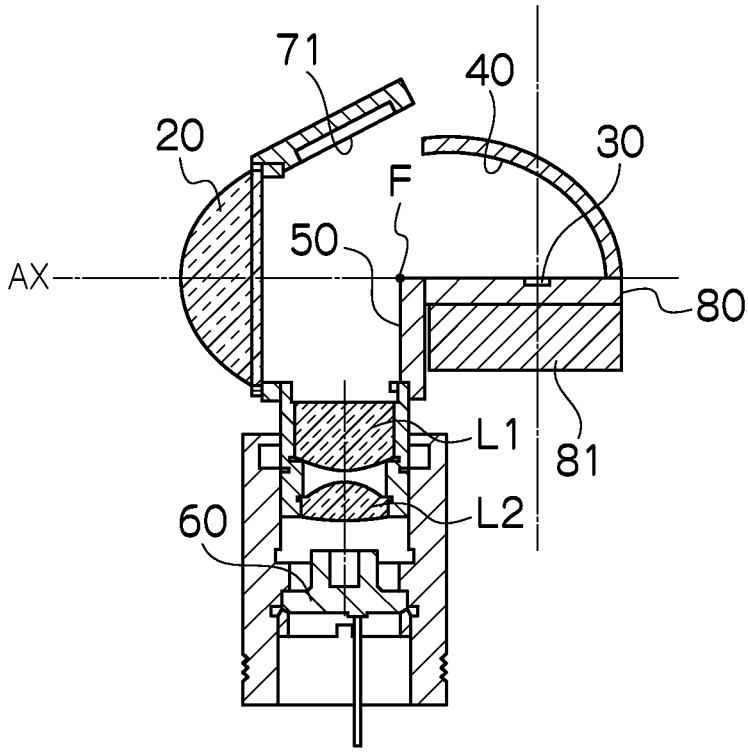
FIG. 7A is a cross-sectional view taken along the vertical cross-section including the optical axis of the vehicular lighting fixture unit (Modified Example 1)

For example, as illustrated in FIG. 7A, a plane mirror 71 may be used as the second reflecting surface instead of the spheroidal reflecting surface, and a focusing lens group (for example, two condenser lenses L1 and L2) may be placed between the semiconductor light-emitting element 60 and the second reflecting surface (the plane mirror 71).

Figure 7B:
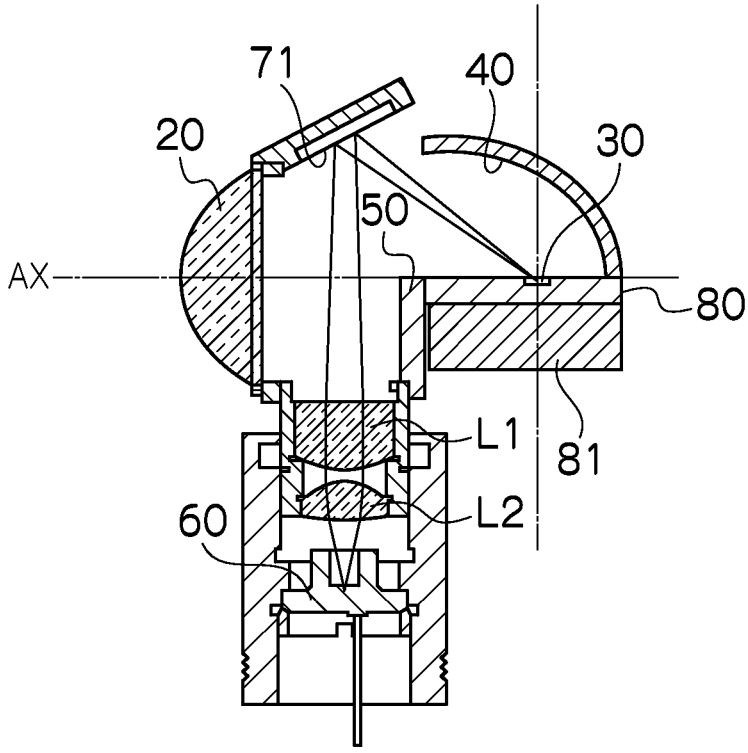
FIG. 7B is a view for describing the optical path of the light from the semiconductor light-emitting element, the light passing through condenser lenses and being reflected on a plane mirror to be condensed on the phosphor.

In FIG. 7A, the condenser lens L2 is placed closer to the semiconductor light-emitting element 60 and serves to collimate the light from the semiconductor light-emitting element 60. The condenser lens L1 can be placed farther from the semiconductor light-emitting element 60 and can serve to condense the light from the semiconductor light-emitting element 60 collimated by the condenser lens L2, on the phosphor 30 via the plane mirror 71 (see FIG. 7B).

According to the vehicular lighting fixture unit 10 of the present modified example, similarly, with the use of the plane mirror 71 that is placed so as to be closer to the vehicle front side than the vehicle front-side opening end 41 of the first reflecting surface 40 (see FIG. 7A), the semiconductor light-emitting element 60 can be placed between the projector lens 20 and the rear-side focal point F of the projector lens 20 at a position lower than the optical axis AX (see FIG. 7A). With this configuration, the size of the vehicular lighting fixture unit 10 in the optical axis AX direction is defined by the rear end of the first reflecting surface 40, and hence it is possible to configure the small-sized vehicular lighting fixture unit having a size in the optical axis AX direction that is smaller than that of the conventional vehicular lighting fixture unit 200 (see FIG. 11).

Modified Example 2

Figure 8A:
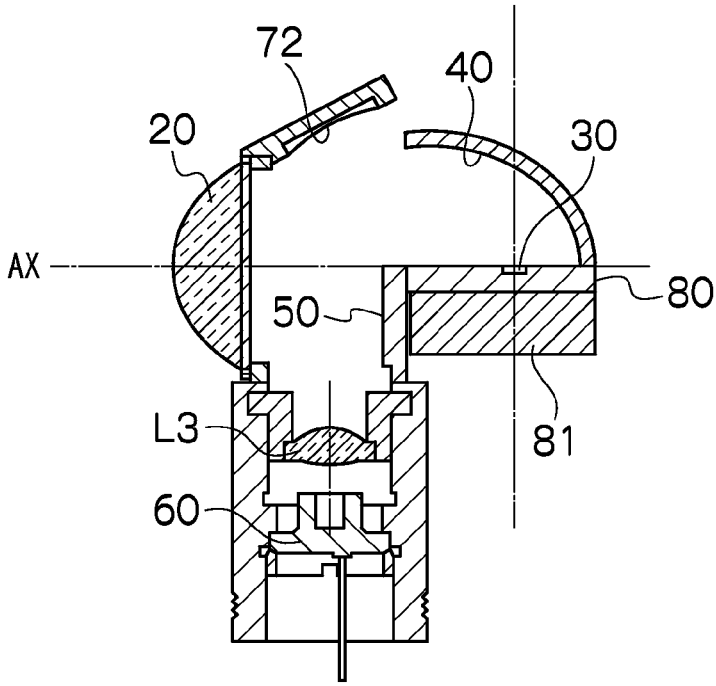
FIG. 8A is a cross-sectional view taken along the vertical cross-section including the optical axis of the vehicular lighting fixture unit (Modified Example 2)

As illustrated in FIG. 8A, a concave mirror 72 may be used as the second reflecting surface instead of the spheroidal reflecting surface, and a condenser lens L3 may be placed between the semiconductor light-emitting element 60 and the second reflecting surface (the concave mirror 72).

Figure 8B:
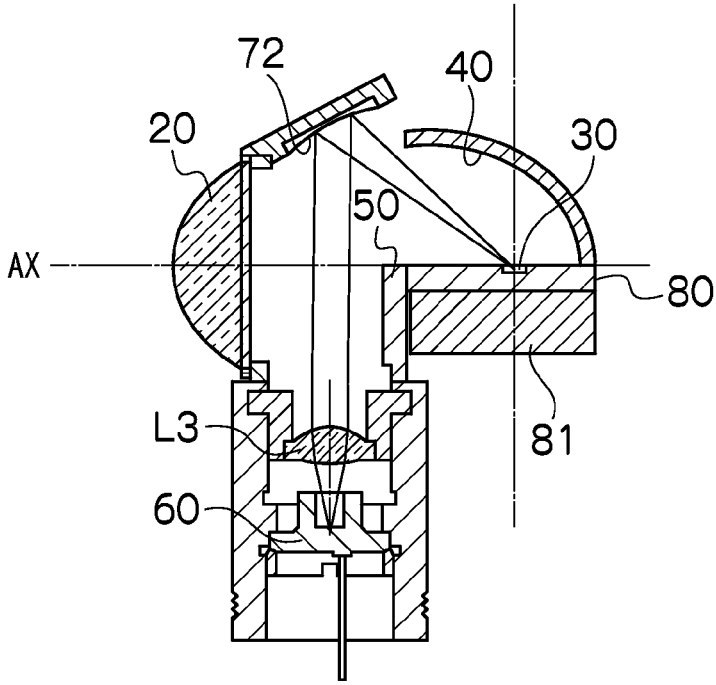
FIG. 8B is a view for describing the optical path of the light from the semiconductor light-emitting element, the light passing through a condenser lens and being reflected on a concave mirror to be condensed on the phosphor.

In FIG. 8A, the condenser lens L3 serves to collimate the light from the semiconductor light-emitting element 60, and the concave mirror 72 serves to condense the light from the semiconductor light-emitting element 60 collimated by the condenser lens L3, on the phosphor 30 (see FIG. 8B).

According to the vehicular lighting fixture unit 10 of the present modified example, similarly, with the use of the concave mirror 72 that is placed so as to be closer to the vehicle front side than the vehicle front-side opening end 41 of the first reflecting surface 40 (see FIG. 8A), the semiconductor light-emitting element 60 can be placed between the projector lens 20 and the rear-side focal point F of the projector lens 20 at a position lower than the optical axis AX (see FIG. 8A). With this configuration, the size of the vehicular lighting fixture unit 10 in the optical axis AX direction is defined by the rear end of the first reflecting surface 40, and hence it is possible to configure the small-sized vehicular lighting fixture unit having a size in the optical axis AX direction that is smaller than that of the conventional vehicular lighting fixture unit 200 (see FIG. 11).

Modified Example 3

In the above-mentioned embodiment, it is assumed that the vehicular lighting fixture unit 10 is the vehicular lighting fixture unit for low beam that forms the light distribution pattern P1 for low beam (see FIG. 5) including the cut-off line CL formed as the reverse projection image of the upper end edge of the shade 50. However, the presently disclosed subject matter is not limited thereto.

For example, the vehicular lighting fixture unit 10 may be a vehicular lighting fixture unit for high beam that forms a light distribution pattern P2 for high beam (see FIG. 10) including a hot zone $H_z$ formed in a region including the vertical line V-V and the horizontal line H-H. For example, as illustrated in FIG. 9, the shade 50 can be removed from the vehicular lighting fixture unit 10 illustrated in FIG. 3, and the first reflecting surface 40 can be used as a reflecting surface for forming the light distribution pattern P2 for high beam, whereby the vehicular lighting fixture unit for high beam can be configured.

Figure 9:
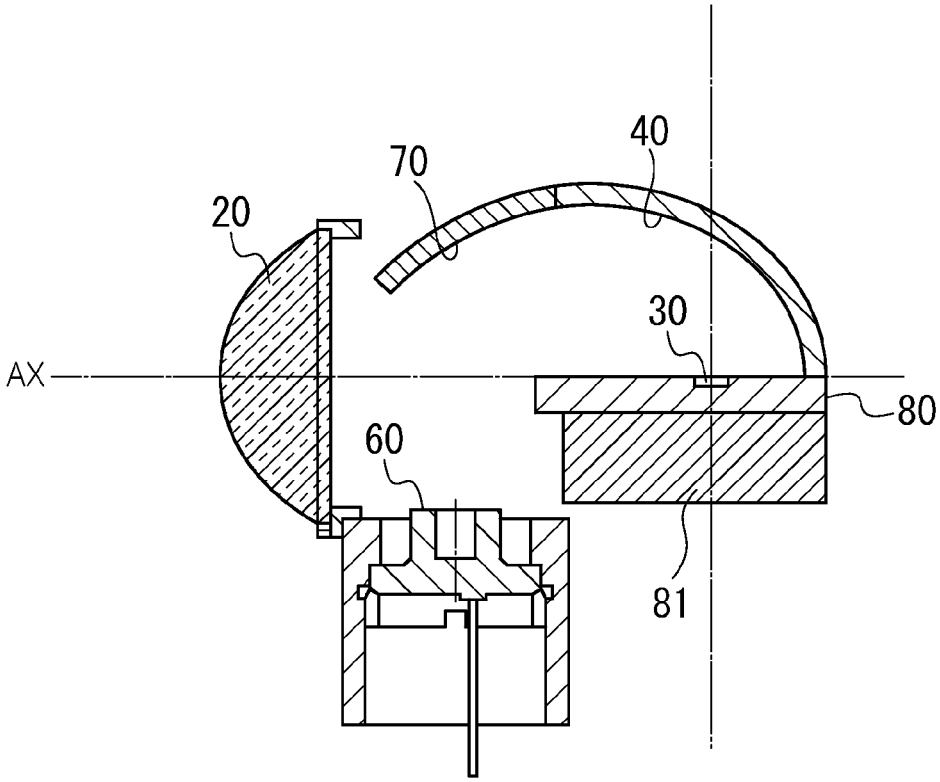
FIG. 9 is a cross-sectional view taken along the vertical cross-section including the optical axis of the vehicular lighting fixture unit (Modified Example 3)
Figure 10:
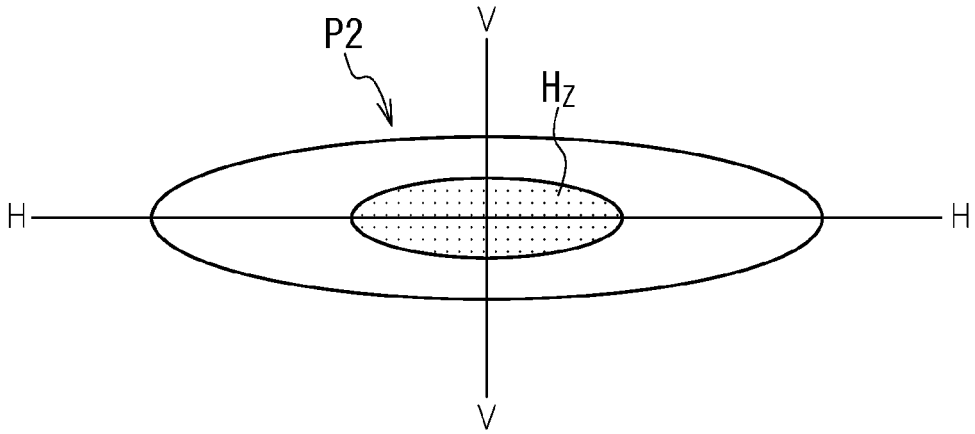
FIG. 10 illustrates an example of a light distribution pattern for high beam that is formed on a virtual vertical screen facing the vehicle front-end part by the vehicular lighting fixture unit.

According to the vehicular lighting fixture unit 10 of the present modified example, similarly, with the use of the second reflecting surface 70 that is placed so as to be closer to the vehicle front side than the vehicle front-side opening end 41 of the first reflecting surface 40 (see FIG. 9), the semiconductor light-emitting element 60 can be placed between the projector lens 20 and the rear-side focal point F of the projector lens 20 at a position lower than the optical axis AX (see FIG. 9). With this configuration, the size of the vehicular lighting fixture unit 10 in the optical axis AX direction is defined by the rear end of the first reflecting surface 40, and hence it is possible to configure the small-sized vehicular lighting fixture unit having a size in the optical axis AX direction that is smaller than that of the conventional vehicular lighting fixture unit 200 (see FIG. 11).

In the above-mentioned embodiments and respective modified examples, it is assumed that the semiconductor light-emitting element 60 is a laser light source that emits blue laser light and the phosphor 30 is the phosphor (a crystalline body such as YAG) that emits light (yellow light) when the light from the semiconductor light-emitting element 60 excites the phosphor 30. However, the presently disclosed subject matter is not limited thereto. For example, the semiconductor light-emitting element 60 may be a semiconductor light-emitting element that emits light (for example, ultraviolet light) having a wavelength other than that of the blue light, and the phosphor 30 may be a phosphor that emits light having a wavelength other than that of the yellow light.

In addition, in the above-mentioned embodiment and the respective modified examples, it is assumed that the semiconductor light-emitting element 60 is a laser light source. However, the presently disclosed subject matter is not limited thereto. For example, the semiconductor light-emitting element 60 may be an LED (light-emitting diode) chip (for example, a high-directivity LED chip) or a super luminescent diode instead of the laser light source. Various colored light LEDs and/or lasers can be used, and combined with an appropriate phosphor or wavelength converting material. It should also be emphasized that although the depicted embodiments are configured for use as a vehicle light, the principles of the disclosed subject matter are suitable for use in other applications such as general lighting, architectural lighting, street lighting, transportable lighting, and the like.

The above-mentioned embodiment and modified examples are mere examples in all respects. The presently disclosed subject matter should not be limitatively interpreted on the basis of the description in the embodiments and modified examples. The presently disclosed subject matter can be carried out in various other modes without departing from the spirit or main features thereof.

What is claimed is:

1. A vehicular lighting fixture comprising:

a projector lens disposed on an optical axis extending in a vehicle front-rear direction;

a light-emitting element disposed between the projector lens and a rear-side focal point of the projector lens and at a position lower than the optical axis so as to emit light substantially vertically upward when operated;

a phosphor disposed closer to a vehicle rear side than the rear-side focal point of the projector lens, the phosphor configured to emit light when the light from the light-emitting element excites the phosphor;

a first reflecting surface configured to reflect the light from the phosphor so as to condense the light emitted from the phosphor toward the optical axis; and a second reflecting surface disposed substantially vertically above the light-emitting element at a position at which the second reflecting surface does not block the light reflected from the first reflecting surface, the second reflecting surface configured to reflect the light from the light-emitting element toward the phosphor.

2. The vehicular lighting fixture according to claim 1, further comprising a shade located between the projector lens and the phosphor with an upper end edge of the shade being disposed substantially at the rear-side focal point of the projector lens, the shade configured to block part of the light reflected from the first reflecting surface.

3. The vehicular lighting fixture according to claim 1, wherein the second reflecting surface is a spheroidal reflecting surface having a first focal point located substantially at the light-emitting element and a second focal point located substantially at the phosphor.

4. The vehicular lighting fixture according to claim 1, further comprising at least one condenser lens located between the light-emitting element and the second reflecting surface, said at least one condenser lens configured to condense the light from the light-emitting element.

5. The vehicular lighting fixture according to claim 1, further comprising a collimator lens located between the light-emitting element and the second reflecting surface, the collimator lens configured to convert the light from the light-emitting element into collimated light, wherein the second reflecting surface is a curved mirror configured to condense the parallel light converted by the collimator lens on the phosphor.

6. The vehicular lighting fixture according to claim 1, wherein an angle at which the light reflected from the second reflecting surface enters the phosphor is between 30 and 60 degrees.

7. The vehicular lighting fixture according to claim 1, wherein a longitudinal direction of a light source image of the light-emitting element is orthogonal to the optical axis, the light source image being formed by light emitted to the phosphor.

8. The vehicular lighting fixture according to claim 1, wherein an area of a light source image of the light-emitting element is equal to or less than one square millimeter, the light source image being formed by light emitted to the phosphor.

9. The vehicular lighting fixture according to claim 1, wherein the light-emitting element is a semiconductor light-emitting element.

10. The vehicular lighting fixture according to claim 1, wherein the light-emitting element is a laser.

11. The vehicular lighting fixture according to claim 1, wherein the projector lens, light-emitting element, phosphor, first reflecting surface, and second reflecting surface form a fixture unit.

12. The vehicular lighting fixture according to claim 11, further comprising a second projector lens, a second light-emitting element, a second phosphor, a second first reflecting surface, and a second reflecting surface to form a second fixture unit.

13. The vehicular lighting fixture according to claim 1, wherein the phosphor is located on the optical axis.

14. The vehicular lighting fixture according to claim 1, wherein the light-emitting element is configured to emit light along and substantially uniform about an axis substantially orthogonal to the optical axis.

15. A lighting fixture configured to emit light along an optical axis, comprising:

a projector lens disposed on the optical axis and having a rear-side focal point;

a light-emitting element disposed between the projector lens and the rear-side focal point of the projector lens, the light-emitting element spaced from the optical axis and configured to emit light along an axis substantially orthogonal to and intersecting the optical axis at an intersection location;

a phosphor disposed adjacent the light emitting element such that the intersection location is located between the projector lens and the phosphor, the phosphor configured to emit light when the light from the light-emitting element excites the phosphor;

a first reflecting surface configured to reflect the light from the phosphor towards the projector lens; and a second reflecting surface disposed above the light-emitting element at a position at which the second reflecting surface does not block the light reflected from the first reflecting surface, the second reflecting surface configured to reflect the light from the light-emitting element toward the phosphor.

16. The lighting fixture according to claim 15, further comprising a shade located between the projector lens and the phosphor, the shade including an upper end edge disposed substantially at the rear-side focal point of the projector lens, the shade configured to block part of the light reflected from the first reflecting surface.

17. The lighting fixture according to claim 15, wherein the first reflecting surface and second reflecting surface are integrally formed as a single curved surface.

18. The lighting fixture according to claim 15, wherein the first reflecting surface and second reflecting surface are separate and spaced a distance from each other.

* * * * *